US008381315B1

(12) United States Patent
Wells

(10) Patent No.: US 8,381,315 B1
(45) Date of Patent: Feb. 26, 2013

(54) SPECIALIZED GLOVE APPARATUS

(76) Inventor: Steven D. Wells, Corona, CA (US)

( * ) Notice: Subject to any disclaimer, the term of this patent is extended or adjusted under 35 U.S.C. 154(b) by 172 days.

(21) Appl. No.: 12/906,311

(22) Filed: Oct. 18, 2010

(51) Int. Cl.
*A41D 19/00* (2006.01)

(52) U.S. Cl. ..... 2/160; 2/161.6

(58) Field of Classification Search ..... 2/159, 161.1, 2/161.4, 161.5, 161.6, 161.3, 162, 20, 16; 30/2, 340, 329, 298, 280, 290, 291, 294, 30/314, 286; 441/80; D2/612; 81/357; 294/25
See application file for complete search history.

(56) References Cited

U.S. PATENT DOCUMENTS

| | | | | | |
|---|---|---|---|---|---|
| 61,428 | A | * | 1/1867 | Hindman | 30/123.5 |
| 126,474 | A | * | 5/1872 | Meyn | 30/123.5 |
| 442,254 | A | * | 12/1890 | Hicks | 30/290 |
| 633,220 | A | * | 9/1899 | Sholl | 30/123.5 |
| 758,196 | A | * | 4/1904 | Thomas | 30/123.5 |
| 767,918 | A | * | 8/1904 | Thomas | 30/123.5 |
| 810,098 | A | * | 1/1906 | Walter | 30/123.5 |
| 966,641 | A | * | 8/1910 | Atkison | 30/123.5 |
| 1,091,757 | A | * | 3/1914 | Owen et al. | 30/298 |
| 1,192,160 | A | * | 7/1916 | Boice | 30/123.5 |
| 1,217,905 | A | * | 3/1917 | Boice | 30/123.5 |
| 1,403,002 | A | * | 1/1922 | Barns | 30/123.5 |
| 1,594,151 | A | * | 7/1926 | Chance | 2/16 |
| 1,710,283 | A | * | 4/1929 | Winter | 30/290 |
| 2,353,557 | A | * | 7/1944 | Guthrie | 30/298 |
| 2,819,521 | A | * | 1/1958 | Parker | 30/135 |
| 2,895,139 | A | * | 7/1959 | Compton | 2/161.8 |
| 79,703 | A | * | 7/1968 | Stewart | 30/123.5 |
| 3,872,514 | A | * | 3/1975 | Liebelt | 2/159 |
| 3,981,526 | A | * | 9/1976 | Lundqvist | 294/25 |
| 4,149,296 | A | * | 4/1979 | Stanford | 452/103 |
| 4,680,861 | A | * | 7/1987 | Meurer | 30/298.4 |
| D303,616 | S | * | 9/1989 | Leopoldi | D8/102 |
| 5,133,233 | A | * | 7/1992 | Erwin | 81/3.57 |
| 5,276,922 | A | * | 1/1994 | Floyd, Jr. | 2/160 |
| D347,709 | S | * | 6/1994 | Pearson | D28/63 |
| D351,933 | S | * | 11/1994 | Stoneman | D2/612 |
| 5,590,471 | A | * | 1/1997 | Wiezenthal | 30/294 |
| 5,819,312 | A | * | 10/1998 | Snyder et al. | 2/16 |
| 5,873,788 | A | * | 2/1999 | Hoffman | 473/205 |
| 5,979,062 | A | * | 11/1999 | Prosan | 30/282 |
| 6,016,571 | A | * | 1/2000 | Guzman et al. | 2/167 |
| 6,029,356 | A | * | 2/2000 | Sprinkle | 30/298 |
| 6,298,489 | B1 | * | 10/2001 | Cox | 2/161.6 |
| D517,278 | S | * | 3/2006 | Chernick et al. | D2/615 |
| D541,007 | S | * | 4/2007 | Zhao et al. | D2/614 |
| 7,234,172 | B1 | * | 6/2007 | Hoelscher | 2/161.1 |
| 7,363,660 | B1 | * | 4/2008 | Gilliland et al. | 2/161.6 |
| D569,578 | S | * | 5/2008 | Yan | D2/614 |
| D581,127 | S | * | 11/2008 | Bautista et al. | D2/617 |
| 2002/0038512 | A1 | * | 4/2002 | Votolato | 30/294 |
| 2005/0087653 | A1 | * | 4/2005 | Koch | 244/142 |

(Continued)

*Primary Examiner* — Shelley Self
*Assistant Examiner* — Catherine M Ferreira

(57) ABSTRACT

The specialized glove apparatus has a plurality of fingers, a thumb, a thumb side, a finger side, a backhand, a forehand, a wristband disposed most downwardly, a reinforced panel disposed on the finger side below the fingers, the reinforced panel beginning proximal to the fingers, an abbreviated, substantially stubby spike disposed upwardly and laterally on the reinforced panel, a cutter disposed on the backhand substantially below the thumb, the cutter comprising, a triangulated clam shape, an opened deep recess, a blade disposed completely within the deep recess, a fat lip guide disposed medially on the cutter, at a beginning of the deep recess, a thin upturn disposed laterally on the cutter, the thin upturn opposite the fat lip guide, across the deep recess, and a wrist pad disposed adjacent to the reinforced panel, the wrist pad extended to the wristband.

5 Claims, 2 Drawing Sheets

U.S. PATENT DOCUMENTS

2009/0235428 A1* 9/2009 Horne, III ..... 2/160
2010/0236077 A1* 9/2010 Shirey et al. ..... 30/152
2010/0317247 A1* 12/2010 McGlynn ..... 441/80
2011/0252536 A1* 10/2011 Hendon et al. ..... 2/160

* cited by examiner

SPECIALIZED GLOVE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Experience in EMS and rescue and like activities has taught the importance of tools, especially tools that are quickly utilized in saving lives, where time is of dire criticality. Picture, for example, a rescue worker pulling a fire hose to douse a flaming car, and needing to access the interior of the car quickly in order to save a life. Such situations call for tools at the ready, especially when hands and body are already fully occupied and can only spare seconds or even fractions of a second. The need to break glass is often paramount in such extrication situations. The need to cut through materials such as seatbelts is often required. Such actions must often be performed instantaneously and, again, while typically fully occupied in other needed activities. Further, such actions must not endanger the user unnecessarily. The present apparatus provides a wearable solution to such problems.

FIELD OF THE INVENTION

The specialized glove apparatus relates to gloves and more especially to a specialized glove especially useful in rescue efforts.

SUMMARY OF THE INVENTION

The general purpose of the specialized glove apparatus, described subsequently in greater detail, is to provide a specialized glove apparatus which has many novel features that result in an improved specialized glove apparatus which is not anticipated, rendered obvious, suggested, or even implied by prior art, either alone or in combination thereof.

To attain this, the specialized glove apparatus provides a tool that is selectively worn and thereby immediately used as needed, without reaching, searching, or locating other tools. The apparatus guards a hand used for breaking glass and other such objects, and for cutting through various materials. The spike of the apparatus may be located on a reinforced panel that spreads the force exerted on the spike when used, thereby cushioning any blow to the hand. The spike is short with a wide base, in order to break glass and other such objects, and not merely pierce them. A user may, for example, ball his hand into a fist and use the heel of the hand, with spike, to shatter a window or windshield in order to rapidly extricate a victim from a dangerous auto.

The reinforced panel may be padded, semi-rigid, or even rigid, and may be comprised of various materials, such as steel, plasticized materials, and even composites. The reinforced panel may be extended to include a part of the fingers. The wrist pad, that may be disposed below the reinforced panel, further protects a user's hand when striking an object such as glass, as do the glove fingers, thumb, backhand, and forehand. The wristband may be provided in various make-ups, which include but are not limited to tightly fitted and adjustable bands, elastic bands, and even rigid bands that are fastened in various ways familiar to the art. The cutter may be importantly disposed on the backhand, adjacent to and below the thumb, to allow a user to draw the cutter without endangering either the user or others. This use positioning also provides best application of strength in cutting various materials that must be cut often in haste. The user may, for example, ball up the fist wearing the apparatus and draw the cutter towards himself, across a seatbelt, thereby releasing a trapped victim quickly and without potential injury to either victim or apparatus user.

Thus has been broadly outlined the more important features of the improved specialized glove apparatus so that the detailed description thereof that follows may be better understood and in order that the present contribution to the art may be better appreciated.

An object of the specialized glove apparatus is to provide a wearable rescue tool that is therefore immediately available to a user.

Another object of the specialized glove apparatus is to provide for breaking glass.

A further object of the specialized glove apparatus is to provide for cutting materials.

An added object of the specialized glove apparatus is to negate personal injury in use.

And, an object of the specialized glove apparatus is to be designed for most advantageous and powerful use.

These together with additional objects, features and advantages of the improved specialized glove apparatus will be readily apparent to those of ordinary skill in the art upon reading the following detailed description of presently preferred, but nonetheless illustrative, embodiments of the improved specialized glove apparatus when taken in conjunction with the accompanying drawings.

DETAILED DESCRIPTION OF THE DRAWINGS

With reference now to the drawings, and in particular FIGS. 1 through 5 thereof, the principles and concepts of the specialized glove apparatus generally designated by the reference number 10 will be described.

Figure 1:
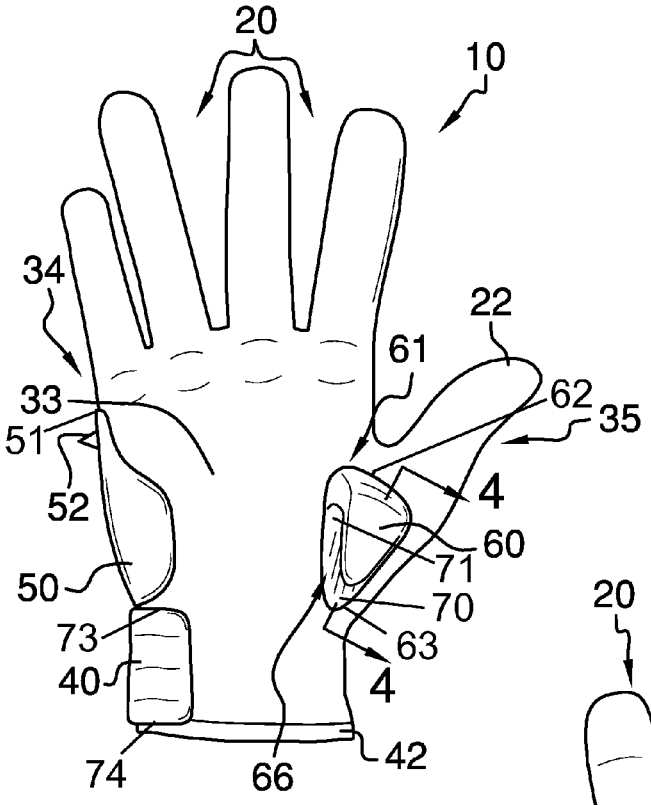
FIG. 1 is a backhand elevation view.

Referring to FIG. 1, the apparatus 10 partially comprises a plurality of fingers 20, a thumb 22, a thumb side 35, a finger side 34, and a backhand 33.

Figure 2:
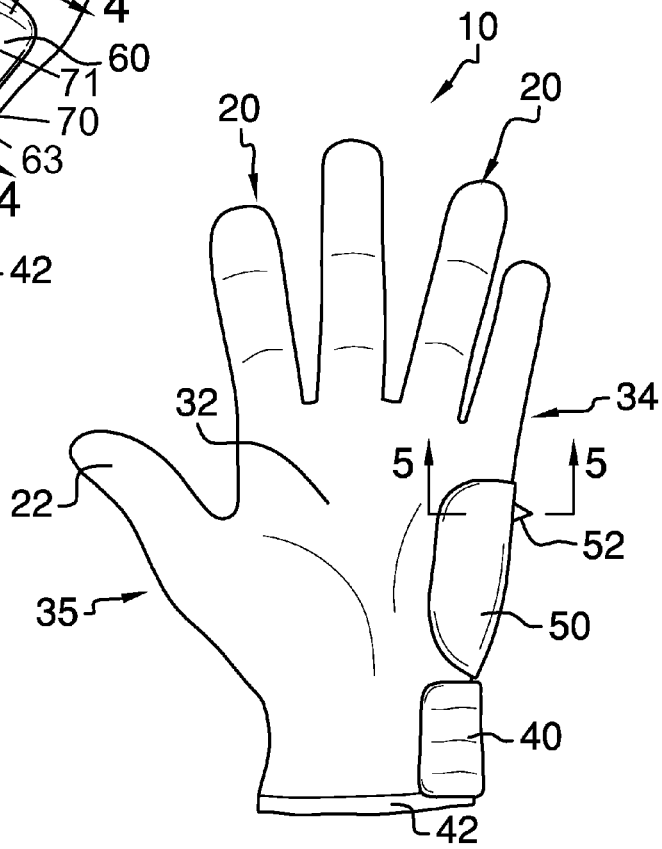
FIG. 2 is a forehand elevation view.

Referring to FIG. 2, the apparatus 10 further comprises a forehand 32 and a wristband 42. The wristband 42 is, in alternate designs, comprised of rigid and of elastic materials.

Figure 3:
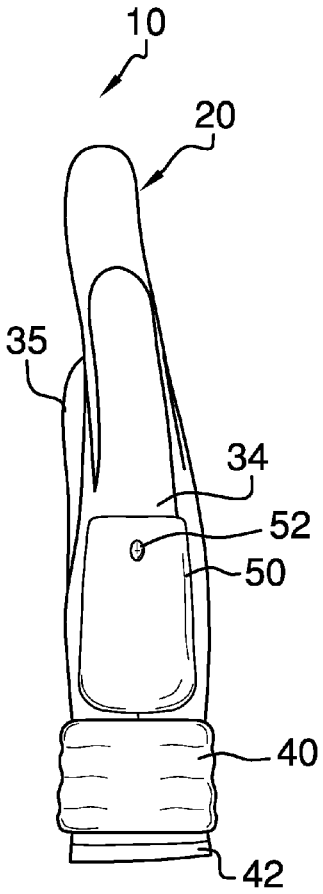
FIG. 3 is a lateral finger biased elevation view.

Referring to FIG. 3, the reinforced panel 50 is disposed on the finger side 34 below the fingers 20.

Figure 5:
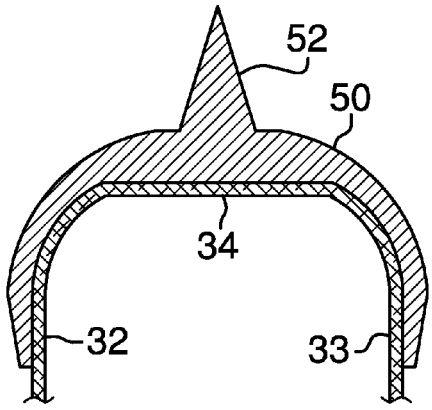
FIG. 5 is a partial cross sectional view of FIG. 2, taken along the line 5-5.

Referring to FIG. 5, the reinforced panel 50 is wrapped to include a part of the backhand 33 and the forehand 32.

Referring again to FIG. 3, the reinforced panel 50 begins proximal to the fingers 20. The abbreviated, substantially stubby cone-shaped spike 52 is disposed on the reinforced panel 50 proximal an upper edge 51 thereof and on the finger side 34 approximately midway between the backhand 33 and the forehand 32. The spike 52 extends laterally from the finger side 34.

Referring to FIG. 1, the cutter 60 is disposed on the backhand 33 between the thumb 22 and the wristband 42 and proximal the thumb side 35, the cutter 60 having a top end 62 more proximal the thumb 22 than the wristband 42 and a bottom end 63 more proximal the wrist band than the thumb.

Figure 4:
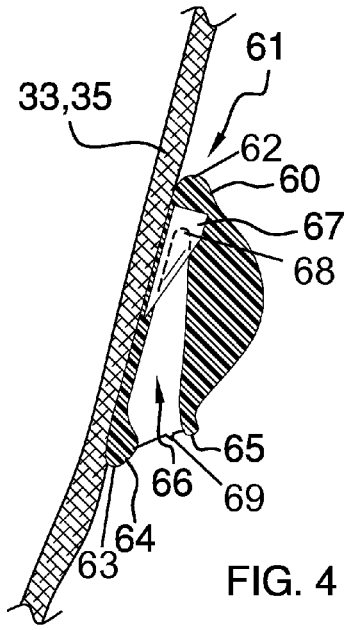
FIG. 4 is a partial cross sectional view of FIG. 1, taken along the line 4-4.

Referring to FIG. 4, the cutter 60 comprises a triangular clam shaped body 61. The cutter 60 further comprises a deep recess 66 disposed within the body 61. The recess 66 has a closed upper end 68 proximal the top end 62 of the cutter 60 and an open lower end 69. An angled blade 67 is disposed completely within the deep recess 66 at the upper end 68 thereof. A lip guide 64 is disposed on the bottom end 63 of the cutter 60 between the lower end 69 of the recess 66 and the thumb side 35. The lip guide 64 is substantially V-shaped. A lower portion 70 of the lip guide 64 is narrower than an upper portion 71 of the lip guide 64. An upturn 65 is disposed on the cutter 60 in a position on an opposite side of the lower end 69 of the recess 66 from the lip guide 64. The upturn 65 has a narrower width than a width of the lip guide 64 lower portion 70.

Referring again to FIGS. 1 and 3, the wrist pad 40 has an uppermost end 73 that is disposed adjacent to the reinforced panel 50 and a lowermost end 74 disposed adjacent to the wristband 42.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the specialized glove apparatus may be used.

What is claimed is:

1. A specialized glove apparatus comprising, in combination:

a plurality of fingers, a thumb, a thumb side, a finger side, a backhand, a forehand, and a wristband;

a reinforced panel disposed on the finger side below the fingers, the reinforced panel wrapped to include a part of the backhand and the forehand, the reinforced panel beginning proximal to the fingers;

a cone-shaped spike disposed on the reinforced panel proximal an upper edge thereof and on the finger side approximately midway between the backhand and the forehand, wherein the spike extends laterally from the finger side;

a cutter disposed on the backhand between the thumb and the wristband and proximal the thumb side, the cutter having a top end more proximal the thumb than the wristband and a bottom end more proximal the wrist band than the thumb, the cutter comprising:

a triangular clam shaped body;

a deep recess disposed within the body, the recess having a closed upper end proximal the top end of the cutter and an open lower end;

a blade disposed completely within the recess at the upper end thereof;

a lip guide disposed on the bottom end of the cutter between the lower end of the recess and the thumb side, wherein the lip guide is substantially V-shaped, wherein a lower portion of the lip guide is narrower than an upper portion of the lip guide;

an upturn disposed on the cutter in a position on an opposite side of the lower end of the recess from the lip guide;

a wrist pad having an uppermost end disposed adjacent to the reinforced panel and a lowermost end disposed adjacent to the wristband.

2. The apparatus according to claim 1 wherein the deep recess gradually widens from the top end toward the bottom end.

3. The apparatus according to claim 1 wherein the blade is further angled, the blade having a wider top portion disposed proximal the top end of the cutter than a bottom portion of the blade.

4. The apparatus according to claim 2 wherein the blade is further angled, the blade having a wider top portion disposed proximal the top end of the cutter than a bottom portion of the blade.

5. A specialized glove apparatus comprising, in combination:

a plurality of fingers, a thumb, a thumb side, a finger side, a backhand, a forehand, and a wristband;

a rigid reinforced panel disposed on the finger side below the fingers, the reinforced panel wrapped to include a part of the backhand and the forehand, the reinforced panel beginning proximal to the fingers;

an abbreviated, substantially stubby cone-shaped spike disposed on the reinforced panel proximal an upper edge thereof and on the finger side approximately midway between the backhand and the forehand, wherein the spike extends laterally from the finger side;

a cutter disposed on the backhand between the thumb and the wristband and proximal the thumb side, the cutter having a top end more proximal thumb, a bottom end more proximal the wrist band than the thumb the cutter comprising:

a triangular clam shaped body;

a deep recess disposed within the body, the recess having a closed upper end proximal the top end of the cutter and an open lower end;

an angled blade disposed completely within the deep recess, the blade having a wider top portion disposed proximal the top end of the cutter than a bottom portion of the blade;

a lip guide disposed on the bottom end of the cutter between the lower end of the recess and the thumb side, wherein the lip guide is substantially V-shaped, wherein a lower portion of the lip guide is narrower than an upper portion of the lip guide;

an upturn disposed on the cutter in a position on an opposite side of the lower end of the recess from the lip guide wherein the upturn has a narrower width than a width of the lip guide lower portion;

a wrist pad having an uppermost end disposed adjacent to the reinforced panel and a lowermost end disposed adjacent to the wristband.

* * * * *